US009278791B2

(12) United States Patent
Kassarjian

(10) Patent No.: US 9,278,791 B2
(45) Date of Patent: Mar. 8, 2016

(54) PROTECTIVE COVER FOR REINFORCING BAR

(71) Applicant: Vasken Kassarjian, Newport Beach, CA (US)

(72) Inventor: Vasken Kassarjian, Newport Beach, CA (US)

( * ) Notice: Subject to any disclaimer, the term of this patent is extended or adjusted under 35 U.S.C. 154(b) by 0 days.

(21) Appl. No.: 14/296,436

(22) Filed: Jun. 4, 2014

(65) Prior Publication Data

US 2014/0283471 A1 Sep. 25, 2014

Related U.S. Application Data

(63) Continuation of application No. 13/397,120, filed on Feb. 15, 2012, now Pat. No. 8,776,464.

(60) Provisional application No. 61/487,235, filed on May 17, 2011.

(51) Int. Cl.

| | |
|---|---|
| ***E04C 5/16*** | (2006.01) |
| ***B65D 59/06*** | (2006.01) |
| ***E04G 21/32*** | (2006.01) |

(52) U.S. Cl.

CPC ..... *B65D 59/06* (2013.01); *E04C 5/161* (2013.01); *E04G 21/3252* (2013.01)

(58) Field of Classification Search

CPC ..... E04C 5/16; E04C 5/161
USPC ..... 52/301, 244, 300, 689, 741.3; 248/523; 138/96 R

See application file for complete search history.

(56) References Cited

U.S. PATENT DOCUMENTS

| | | | |
|---|---|---|---|
| 1,083,120 | A | 12/1913 | May |
| 2,131,319 | A | 9/1938 | Greenholtz et al. |
| 2,215,251 | A | 9/1940 | Prince |
| 3,007,726 | A | 11/1961 | Parkin |
| 3,199,819 | A | 8/1965 | Widmark |
| 3,204,901 | A | 9/1965 | Dunn |
| 3,233,502 | A | 2/1966 | Fernberg |
| 3,485,271 | A | 12/1969 | Halsey |

(Continued)

FOREIGN PATENT DOCUMENTS

| | | |
|---|---|---|
| CN | 1975071 A | 6/2007 |
| DE | 1157436 | 11/1963 |

(Continued)

OTHER PUBLICATIONS

Don De Cristo Concrete Accessories, Inc. Catalog, Plastic Rebar Guard, p. 43.

(Continued)

*Primary Examiner* — William Gilbert
(74) *Attorney, Agent, or Firm* — McDermott Will & Emery LLP

(57) ABSTRACT

A protective cover for covering an end of a reinforcing bar is provided. In some aspects, the protective cover includes a collar having a first end, a second end, and an impact absorbing portion disposed therebetween. The first end of the collar is configured to receive the end of the reinforcing bar. The impact absorbing portion of the collar is configured to withstand an impact without penetration of the reinforcement bar through the protective cover and is further configured to absorb at least a portion of the impact. The impact absorbing portion resides solely within the collar. The protective cover further includes a cap disposed at the second end of the collar. The cap has a surface area of about sixteen square inches.

23 Claims, 5 Drawing Sheets

(56) References Cited

U.S. PATENT DOCUMENTS

| | | | |
|---|---|---|---|
| 3,630,474 | A | 12/1971 | Minor |
| 3,693,310 | A | 9/1972 | Middleton |
| D227,218 | S | 6/1973 | Rastocny |
| 3,741,226 | A | 6/1973 | Urban |
| 3,890,990 | A | 6/1975 | Schafer |
| 4,000,539 | A | 1/1977 | Neyer |
| 4,012,806 | A | 3/1977 | Howie, Jr. |
| 4,080,770 | A | 3/1978 | Vigh |
| 4,098,283 | A | 7/1978 | Tritle, Jr. |
| 4,119,290 | A | 10/1978 | Gies |
| 4,140,451 | A | 2/1979 | Herdzina, Jr. et al. |
| 4,159,096 | A | 6/1979 | Chase |
| 4,179,771 | A | 12/1979 | Rankins et al. |
| 4,202,378 | A | 5/1980 | Bush et al. |
| 4,269,010 | A | 5/1981 | Glass |
| D262,093 | S | 12/1981 | Bush et al. |
| 4,338,270 | A | 7/1982 | Uffindell |
| 4,429,497 | A | 2/1984 | Dibernardi |
| 4,575,978 | A | 3/1986 | Huhn et al. |
| 4,644,726 | A | 2/1987 | Wheeler |
| 4,655,023 | A | 4/1987 | Yung |
| 4,694,863 | A | 9/1987 | Klopp |
| 4,785,858 | A | 11/1988 | Valentini et al. |
| 4,824,136 | A | 4/1989 | Baxter |
| 4,833,850 | A | 5/1989 | Lunn |
| 4,899,771 | A | 2/1990 | Wilkinson |
| 4,939,830 | A | 7/1990 | Janian |
| 4,965,035 | A | 10/1990 | Ishiwatari et al. |
| 4,972,642 | A | 11/1990 | Strobl, Jr. |
| 5,037,595 | A | 8/1991 | Kornelis |
| RE33,764 | E | 12/1991 | Cochrane |
| 5,088,513 | A | 2/1992 | Ostermeyer |
| 5,313,757 | A | 5/1994 | Schnepf |
| 5,353,825 | A | 10/1994 | Davis |
| 5,363,618 | A | 11/1994 | Underwood |
| 5,381,636 | A | 1/1995 | Kassardjian et al. |
| 5,444,957 | A | 8/1995 | Roberts |
| 5,447,290 | A | 9/1995 | Workman |
| D363,657 | S | 10/1995 | Kassardjian et al. |
| 5,469,679 | A | 11/1995 | Burkard et al. |
| 5,523,043 | A | 6/1996 | Kassardjian et al. |
| 5,568,708 | A | 10/1996 | Kassardjian et al. |
| 5,573,348 | A | 11/1996 | Morgan |
| 5,600,927 | A | 2/1997 | Kennon |
| 5,613,336 | A | 3/1997 | Workman |
| 5,687,772 | A | 11/1997 | Underwood |
| 5,729,941 | A | 3/1998 | Kassardjian et al. |
| 5,824,253 | A | 10/1998 | Kassardjian et al. |
| 5,943,836 | A | 8/1999 | Kassardjian |
| 5,946,871 | A | 9/1999 | Kassardjian et al. |
| 6,085,478 | A | 7/2000 | Workman |
| 6,662,514 | B2 | 12/2003 | Workman |
| 7,353,640 | B2 | 4/2008 | Stutler |
| 7,472,522 | B2 | 1/2009 | Yang |
| 2008/0168726 | A1 | 7/2008 | Yang |

FOREIGN PATENT DOCUMENTS

| | | |
|---|---|---|
| DE | 1810356 | 6/1970 |
| DE | 2534928 | 2/1976 |
| DE | 4036919 | 5/1991 |
| GB | 937601 | 9/1963 |
| GB | 963741 | 7/1964 |
| GB | 1479080 | 7/1977 |
| WO | 9114839 | 10/1991 |

OTHER PUBLICATIONS

Deslauriers, Inc. Brochure, "Deslauriers Impalement-Protection Safety Cap DISC System".

PROTECTIVE COVER FOR REINFORCING BAR

CROSS-REFERENCES TO RELATED APPLICATIONS

This application is a continuation of U.S. patent application Ser. No. 13/397,120, entitled "PROTECTIVE COVER FOR REINFORCING BAR," filed on Feb. 15, 2012, which claims the benefit of U.S. Provisional Patent Application Ser. No. 61/487,235, entitled "PROTECTIVE COVER FOR REINFORCING BAR," filed on May 17, 2011, both of which are hereby incorporated by reference in their entireties for all purposes.

STATEMENT AS TO RIGHTS TO INVENTIONS MADE UNDER FEDERALLY SPONSORED RESEARCH OR DEVELOPMENT

Not Applicable.

FIELD

The present invention generally relates to a protective cover and, in particular, relates to a protective cover for a reinforcing bar.

BACKGROUND

A reinforcing bar (rebar) is typically made of steel and utilized to increase the strength of concrete structures. Rebar is installed before concrete is poured and in certain circumstances, may be arranged in a hazardous configuration, with exposed ends susceptible to causing injury to individuals.

Conventional methods for protecting individuals against the exposed ends of rebar, rely on the placement of a protective cover over the end of the rebar. A conventional protective cover, however, utilizes an impact resistant cap that may render the conventional protective cover bulky, costly to produce, and ineffective at withstanding high impact forces due to an inefficient load path.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

Various aspects of the subject technology provide a protective cover for covering an end of a reinforcing bar with a compact and resilient protective cover. The protective cover comprises a collar with an integral impact absorbing portion that provides a compact and low-cost protective cover over the conventional protective cover. In another aspect, the protective cover is capable of withstanding higher a impact force than the conventional protective cover. In some aspects, the collar and integral impact absorbing portion provide a more efficient and hence, effective, load path than the conventional protective cover. In another aspect, the impact absorbing portion is capable of absorbing a portion of the impact force.

Various aspects of the subject technology provide a protective cover comprising a collar having a first end, a second end, and an impact absorbing portion disposed therebetween. The first end of the collar is configured to receive the end of a reinforcing bar. The impact absorbing portion is configured to withstand an impact without penetration of the reinforcement bar through the protective cover and is further configured to absorb at least a portion of the impact. The impact absorbing portion resides solely within the collar. The protective cover also comprises a cap disposed at the second end of the collar. The cap has a surface area of about sixteen square inches.

According to various aspects of the subject technology, a method for absorbing an impact on an end of a reinforcing bar is provided. The method comprises disposing an impact absorbing portion between a first end and a second end of a collar of a protective cover, the protective cover configured to cover the end of the reinforcing bar, wherein the first end is adapted to receive the end of the reinforcing bar, and wherein a cap is disposed at the second end. The method further comprises withstanding the impact with the impact absorbing portion without penetration of the reinforcement bar through the protective cover; and absorbing at least a portion of the impact with the impact absorption portion.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology. Like components are labeled with identical element numbers for ease of understanding.

Various aspects of the subject technology provide a protective cover for covering an end of a reinforcing bar. The protective cover comprises a collar having a first end, a second end, and an impact absorbing portion disposed therebetween. The first end of the collar is configured to receive the end of the reinforcing bar. The impact absorbing portion of the collar is configured to withstand an impact without penetration of the reinforcement bar through the protective cover. In some aspects, by incorporating the impact absorbing portion within the collar, the protective cover is compact and economical to manufacture. In other aspects, by incorporating the impact absorbing portion within the collar, the protective cover dissipates forces through an efficient load path through the protective cover by maintaining a close proximity between the impact absorbing portion and the end of the reinforcing bar. In one aspect, the impact absorbing portion is capable of absorbing at least a portion of an impact force. In another aspect, the protective cover is capable of withstanding a high impact force.

Figure 1A:
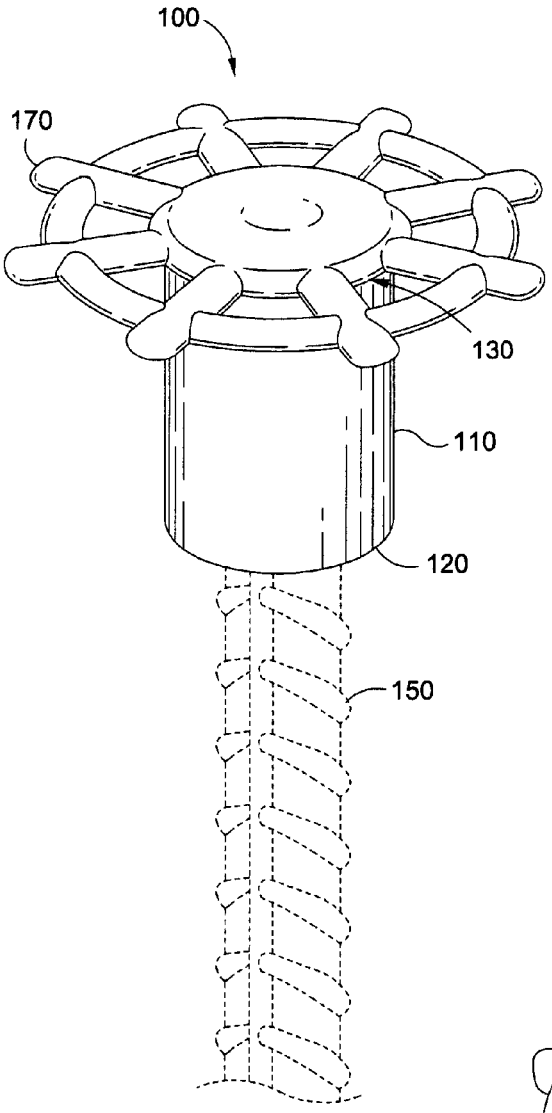
FIG. 1A illustrates a protective cover and a reinforcing bar, in accordance with various aspects of the subject technology.
Figure 1B:
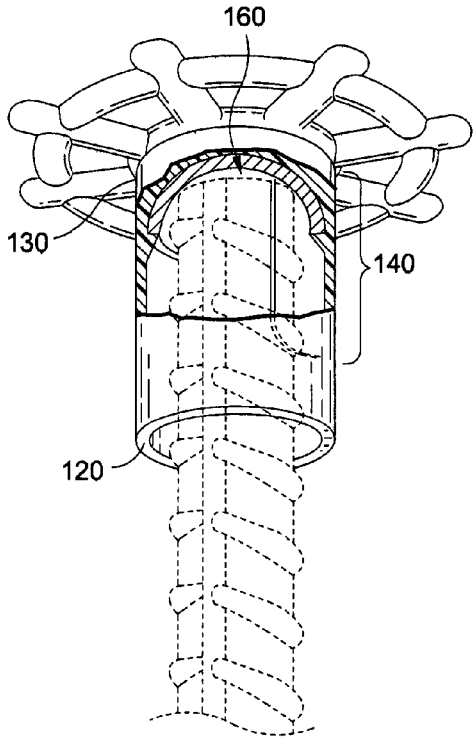
FIG. 1B illustrates a cutaway of a protective cover and a reinforcing bar, in accordance with various aspects of the subject technology.

FIGS. 1A and 1B illustrate a protective cover 100 and a reinforcing bar 150, in accordance with various aspects of the subject technology. The protective cover 100 is configured to cover an end of the reinforcing bar 150. The protective cover 100 may comprise a collar 110 having a first end 120, a second end 130, and an impact absorbing portion 140 disposed therebetween. The first end 120 of the collar 110 may be adapted to receive the end 160 of the reinforcing bar 150. The impact absorbing portion 140 may reside solely within the collar 110 and may be configured to withstand an impact without penetration of the reinforcement bar 150 through the protective cover 100, and may further be configured to absorb at least a portion of the impact. The protective cover 100 may further comprise a cap 170 disposed at the second end 130. The cap 170 may have a surface area of about sixteen square inches.

In one aspect, the collar 110 may be manufactured from a plastic, polymer, or other similar material and have a generally cylindrical shape. In some aspects, the collar 110 may have a generally constant diameter. In another aspect, the collar 110 may have an outer diameter of about 1.8 inches.

Figure 2:
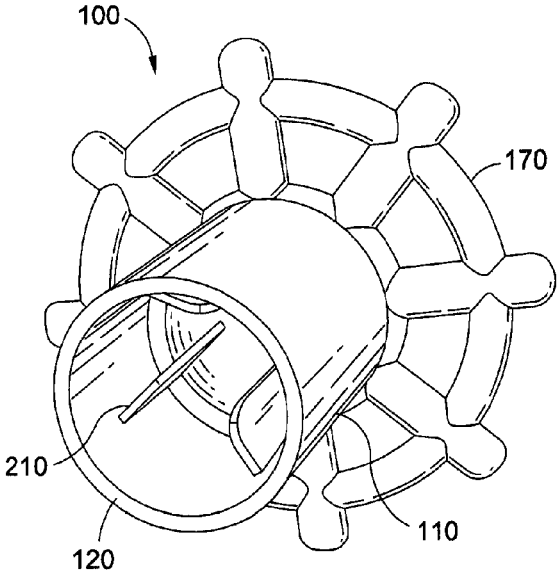
FIG. 2 illustrates an isometric view of a protective cover, in accordance with various aspects of the subject technology.

FIG. 2 illustrates an isometric view of the protective cover 100, in accordance with various aspects of the subject technology. In some aspects, the first end 120 of the collar 110 is adapted to receive the end of the reinforcing bar 150 by utilizing a plurality of inwardly extending fins 210. The fins 210 may be configured to securely and removably engage an outer surface of the reinforcing bar 150. For example, the fins 210 may be comprised of pliable material, configured to flex and grip the outer surface of the reinforcing bar 150 with friction. In another aspect, the fins 210 may position and maintain the protective cap 100 onto the end 160 of the reinforcing bar 150.

Figure 3:
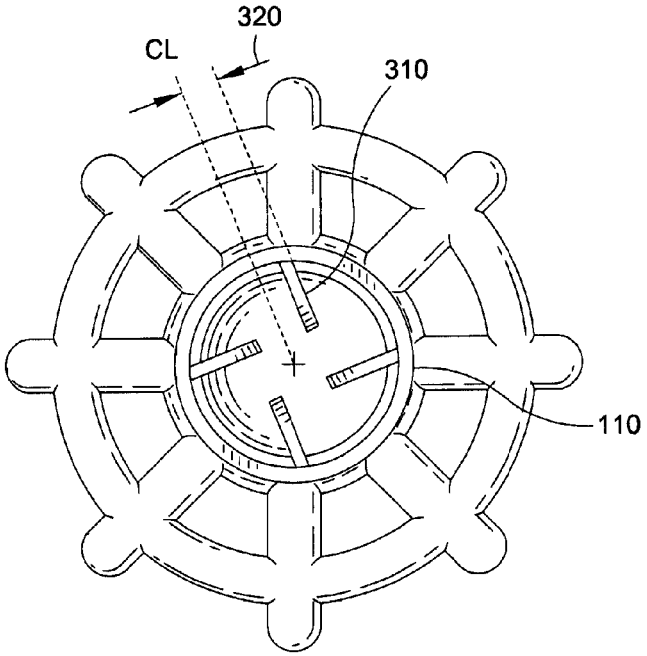
FIG. 3 illustrates a bottom view of a protective cover, in accordance with various aspects of the subject technology.

FIG. 3 illustrates a bottom view of the protective cover 100, in accordance with various aspects of the subject technology. In one aspect, the fins 310 are configured to accommodate a reinforcing bar 150 of varying diameters. For example, the fins 310 may be positioned off-center 320, extending inwardly from the collar 110, to facilitate accommodation of differently sized reinforcing bars 150. The off-center fins 310 accommodate differently sized reinforcing bars 150 by encouraging the fins 310 to flex in the off-center direction when interacting with the outer surface of the reinforcing bar 150. The fins 310, although in a flexed position, maintain sufficient contact with the outer surface of the reinforcing bar 150 to thereby securely position and maintain the protective cover 100 onto the end 160 of the reinforcing bar 150. In one aspect, the fins 310 may be configured to return to their non-flexed position after the reinforcing bar 150 is removed.

Figure 4A:
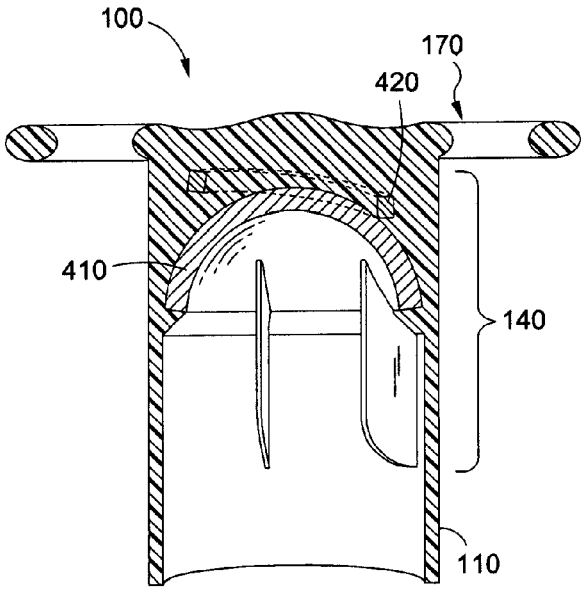
FIG. 4A illustrates a cross section of an impact absorbing portion with a seat and a split ring, in accordance with various aspects of the subject technology.

FIG. 4A illustrates a cross section of the protective cover 100, in accordance with various aspects of the subject technology. In one aspect of the subject technology, the protective cover 100 has an impact absorbing portion 140 disposed solely within the collar 110. The impact absorbing portion 140 may comprise a seat 410 configured to engage the end 160 of the reinforcing bar 150. The seat 410 may be configured to maintain the position of the protective cover 100 relative to the reinforcing bar 150 upon, during, and after impact. For example, the seat 410 may have a generally semi-spherical shape in order to maintain engagement of the seat 410 and the reinforcing bar 150 upon, during, and after impact. By having a non-planar shape, the seat 410 contains the end 160 of the reinforcement bar 150, regardless of an off-center application of an impact force.

In one aspect of the subject technology, the impact absorbing portion 140 is configured to withstand the impact force without penetration of the reinforcement bar 150 through the protective cover 100, including the collar 110 and the cap 170. For example, the impact absorbing portion 140 may comprise the seat 410 that is configured to engage the end 160 of the reinforcing bar 150. In this example, the seat 410 may comprise a rigid material, such as steel, and may be about 4 mm thick. In one aspect, the seat 410 may be configured to provide the primary means for preventing the end 160 of the reinforcing bar 150 from penetrating the protective cap 100 upon impact.

Figure 4B:
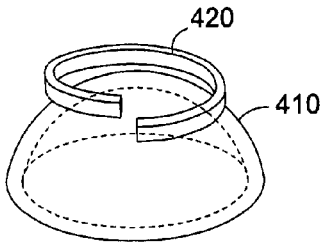
FIG. 4B illustrates a seat and a split ring of an impact absorbing portion, in accordance with various aspects of the subject technology.
Figure 4C:
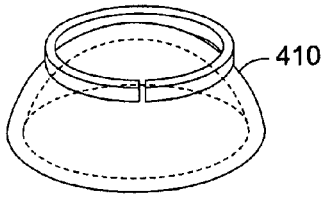
FIG. 4C illustrates a seat and a split ring of an impact absorbing portion, in accordance with various aspects of the subject technology.

In some aspects, the impact absorbing portion 140 may comprise additional components, aside from the seat 410, to increase the impact resistant properties of the protective cap 100. Referring to FIG. 4A, the impact absorbing portion 140 may comprise the seat 410 and a split ring 420. The split ring 420 may, for example, comprise hardened steel, integrally molded within the collar 110 and positioned above the seat 420, thereby increasing the impact resistant properties of the protective cap 100. Referring to FIGS. 4B and 4C, the split ring 420 may be configured such that the ends of the split ring 420 are non-planar or planar. In one aspect, adjusting the ends of the split ring 420 so that they are non-planar, allows the split ring 420 to absorb a portion of the impact force through a deflection and/or compression of the split ring 420.

Figure 4D:
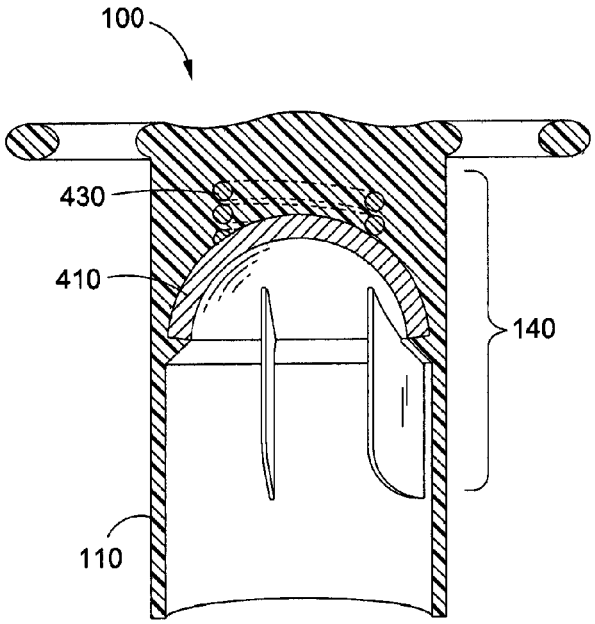
FIG. 4D illustrates a cross section of an impact absorbing portion with a seat and a spring, in accordance with various aspects of the subject technology.
Figure 4E:
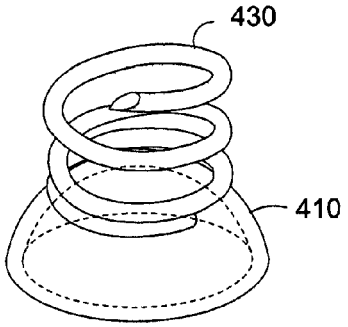
FIG. 4E illustrates a seat and a spring of an impact absorbing portion, in accordance with various aspects of the subject technology.

Referring to FIGS. 4D and 4E, the impact absorbing portion 140 may comprise the seat 410 and a spring 430. In some aspects, the spring 430 may comprise a steel spring disposed above the seat 410, thereby increasing the impact resistant properties of the protective cap 100. In one aspect, the spring 430 comprises about two or more coils configured to deflect and thereby absorb a portion of the impact force through the deflection and compression of the spring 430.

Figure 4F:
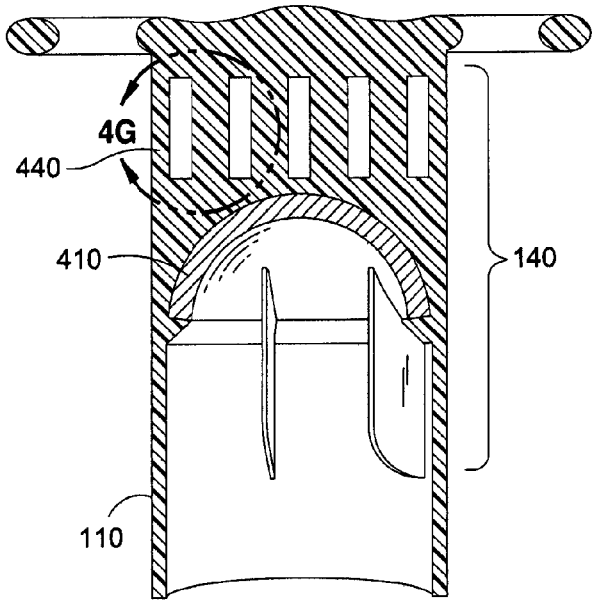
FIG. 4F illustrates a cross section of an impact absorbing portion with a seat and a crumple portion, in accordance with various aspects of the subject technology.
Figure 4G:
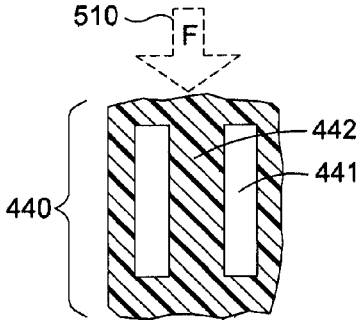
FIG. 4G illustrates an impact force acting on a crumple portion, in accordance with various aspects of the subject technology.
Figure 4H:
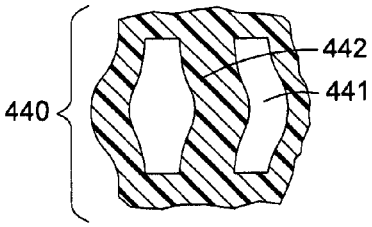
FIG. 4H illustrates a deflection of a crumple portion, in accordance with various aspects of the subject technology.

Referring to FIGS. 4F, 4G and 4H, the impact absorbing portion 140 may comprise the seat 410 and a crumple portion 440. In some aspects, the crumple portion 440 may comprise a plurality of openings 441 and columns 442 disposed above the seat 410, wherein the openings 441 are sized to provide a sufficient clearance for the columns 442 to deform upon application of the impact force 510. In some aspects, deformation of the columns 442 provides absorption of at least a portion of the impact force 510 by the protective cap 100.

Figure 4I:
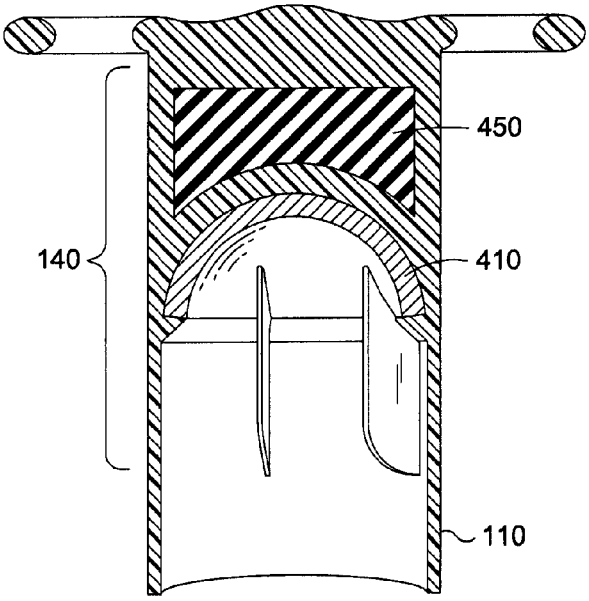
FIG. 4I illustrates a cross section of an impact absorbing portion with a seat and a strengthening material, in accordance with various aspects of the subject technology.

Referring to FIG. 4I, the impact absorbing portion 140 may comprise the seat 410 and a strengthening material 450. The strengthening material 450 may be disposed above the seat 410. In some aspects, the strengthening material 450 comprises a high strength polymer configured to increase the impact resistant properties of the protective cap 100. The strengthening material 450 may, for example, comprise a carbon reinforced polymer, a high strength composite, and/or a high strength ceramic. In other aspects, the strengthening material is integrally molded into the impact absorbing portion 140.

Figure 4J:
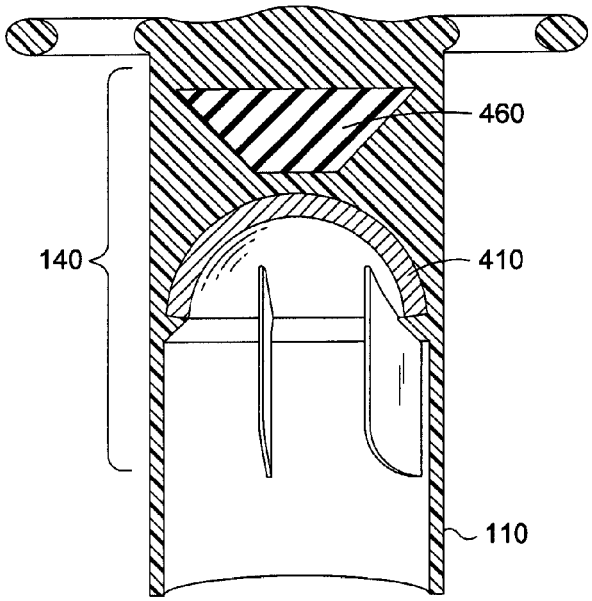
FIG. 4J illustrates a cross section of an impact absorbing portion with a seat and an absorption material, in accordance with various aspects of the subject technology.

Referring to FIG. 4J, the impact absorbing portion 140 may comprise the seat 410 and an absorption material 460. The absorption material 460 may be disposed above the seat 410. In some aspects, the absorption material 460 comprises an energy absorption polymer configured to absorb at least a portion of the impact force. The absorption material 460 may, for example, comprise a foam, polymer, a graphite composite, a laminate ceramic, rubber, wood, and/or cork. In other aspects, the absorption material is integrally molded into the impact absorbing portion 140.

In one aspect, the impact absorbing portion 140 may be configured to satisfy the Occupational Safety and Health Standards Board (OSHA) safety standards requiring the use of protective covers for covering the exposed ends of reinforcing steel bars so as to prevent injury and impalement. The standard provides that workers working at grade, above grade, or at any surface and exposed to reinforcing steel or other projections shall be protected against the hazard of impalement by guarding the exposed protruding end of the reinforcing bar with a protective cover. The OSHA standard requires that the protective cover be made of wood, plastic, or any similar material, and should be capable of withstanding, at a minimum, the impact of a 250 pound weight dropped from a height of 10 feet without penetration failure of the cover, and that the surface area of the protective cover shall be a minimum of a 4"×4" square surface area.

In one aspect, the impact absorbing portion 140 may be configured to withstand an impact of a 250 pound weight dropped from a height of 10 feet, without penetration of the reinforcement bar 150 through the protective cover 100, the collar 110, or the cap 170. For example, the impact absorbing portion 140, residing solely in the collar 110, may comprise the seat 410 and the split ring 420. In this example, the split ring 420 may be disposed between the seat 410 and the second end of the collar 130. Upon impact of the 250 pound weight onto the protective cover 100, the split ring 420 may absorb at least a portion of the impact force via deflection of the split ring 420, as discussed above. The seat 410 directly engages the end 160 of the reinforcing bar 150 and acts as the primary means for preventing the reinforcing bar 150 from penetrating the protective cover 100, collar 110, or cap 170. The split ring 420 provides a secondary means for preventing the reinforcing bar 150 from penetrating the protective cover 100, collar 110, or cap 170.

Figure 5:
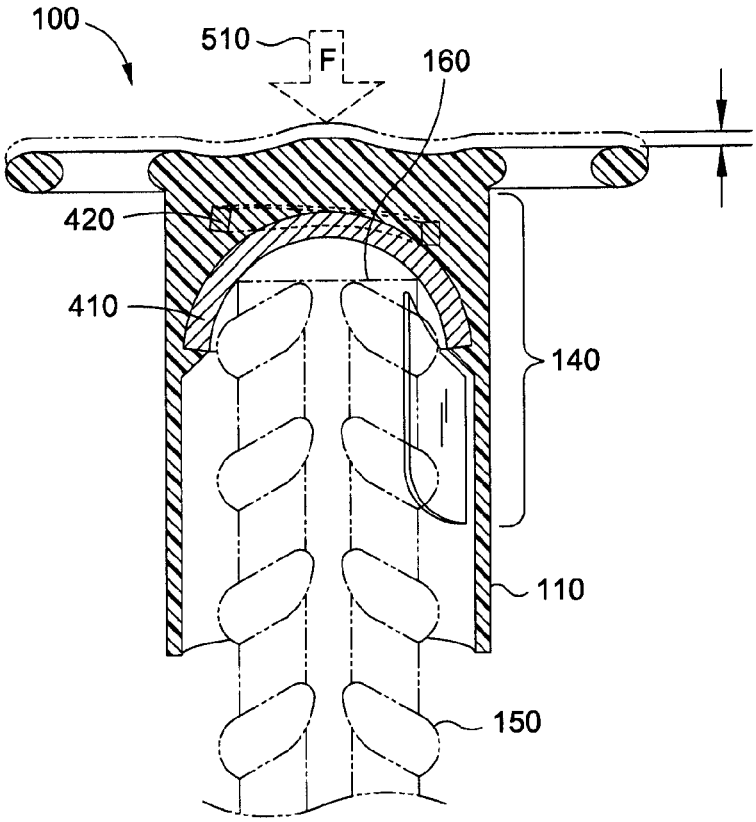
FIG. 5 illustrates a cross section of a protective cover and an impact force, in accordance with various aspects of the subject technology.

FIG. 5 illustrates a cross section of the protective cover 100 and the impact force 510, in accordance with various aspects of the subject technology. In one aspect, by incorporating the impact absorbing portion 140 solely within the collar 110, the protective cover 100 provides a more efficient and hence, effective, load path over the conventional protective cover. For example, by maintaining a close proximity between the impact absorbing portion 140 and the end 160 of the reinforcing bar 150, a shorter load path is created that enables the impact force 510 to be efficiently absorbed and dissipated by the impact absorbing portion 140. In this example, the split ring 420 and the seat 410 provide a load path through the protective cover 100. The downward impact force 510 may travel through the protective cover 100 by first encountering the split ring 420 and then the seat 410. By first encountering the split ring 420, a portion of the impact force 510 is absorbed and dissipated by the split ring 420. The remainder of the impact force 510 is then encountered by the seat 410 and transferred to the end 160 of the reinforcing bar 150. The load path in this example may resemble a generally conical or cylindrical shape, depending on the geometry of the contact points/area between the corners of the end of the 160 of the reinforcing bar 150 and the seat 410, and the contact points/area between the seat 410 and the split ring 420.

In one aspect, the impact absorbing portion 140 absorbs more of the impact force than the conventional protective cover. For example, Table 1 provides the test results from an impact resistance test, whereby a weight of 30.5 lbf was dropped from a height of 28.75 inches onto two samples of the conventional protection covers (identified in Table 1 as Conventional Protective Cover Nos. 1-2), three samples of the protective cover 100 having the impact absorbing portion 140 comprising the seat 410 (identified in Table 1 as Protective Cover with Seat Nos. 1-3), and three samples of the protective cover 100 having the impact absorbing portion 140 comprising the seat 410 and the absorption material 460 comprising rubber/silicon (identified in Table 1 as Protective Cover with Seat and Absorption Material Nos. 1-3). As shown in Table 1, the "Protective Cover with Seat" samples and the "Protective Cover with Seat and Absorption Material" samples both absorbed more of the impact force than the "Conventional Protective Cover" samples, as demonstrated by the reduced amount of the "Maximum Impact Load.". In addition, the "Protective Cover with Seat and Absorption Material" samples absorbed more of the impact force than the "Protective Cover with Seat" samples, thereby illustrating the impact absorbing properties of the absorption material 460.

TABLE 1

| Test Sample | Impact Velocity | Maximum Impact Load | Time to Maximum Load | Total Energy |
|---|---|---|---|---|
| Conventional Protective Cover #1 | 12.14 ft/sec | 10,745.72 lb | 1.52 msec | −344.50 ft-lb |
| Conventional Protective Cover #2 | 12.21 ft/sec | 10,510.99 lb | 1.96 msec | −379.51 ft-lb |

TABLE 1-continued

| Test Sample | Impact Velocity | Maximum Impact Load | Time to Maximum Load | Total Energy |
|---|---|---|---|---|
| Protective Cover with Seat #1 | 12.09 ft/sec | 6,087.63 lb | 2.45 msec | −293.19 ft-lb |
| Protective Cover with Seat #2 | 12.24 ft/sec | 6,009.54 lb | 2.51 msec | −293.77 ft-lb |
| Protective Cover with Seat #3 | 12.14 ft/sec | 6,284.97 lb | 2.21 msec | −293.50 ft-lb |
| Protective Cover with Seat and Absorption Material #1 | 12.04 ft/sec | 5,593.23 lb | 2.71 msec | −281.79 ft-lb |
| Protective Cover with Seat and Absorption Material #2 | 12.27 ft/sec | 5,794.05 lb | 2.76 msec | −312.16 ft-lb |
| Protective Cover with Seat and Absorption Material #3 | 12.35 ft/sec | 5,690.08 lb | 2.39 msec | −305.94 ft-lb |

In another aspect, the impact absorbing portion 140 generally decelerated the impact force more than the conventional protective cover. As shown in Table 1, the "Protective Cover with Seat" samples and the "Protective Cover with Seat and Absorption Material" samples both generally decelerated the impact force more than the "Conventional Protective Cover" samples, as demonstrated by the increased amount of "Time to Maximum Load."

In some aspects, because the impact absorbing portion 140 absorbs and dissipates a portion of the impact force, less energy is ultimately transmitted to the reinforcing bar 150, as demonstrated by the reduced amount of "Total Energy" in Table 1.

In another aspect, by integrating the impact absorbing portion 140 into the collar 110, the protective cover 100 is compact, and hence, economical to manufacture.

Figure 6:
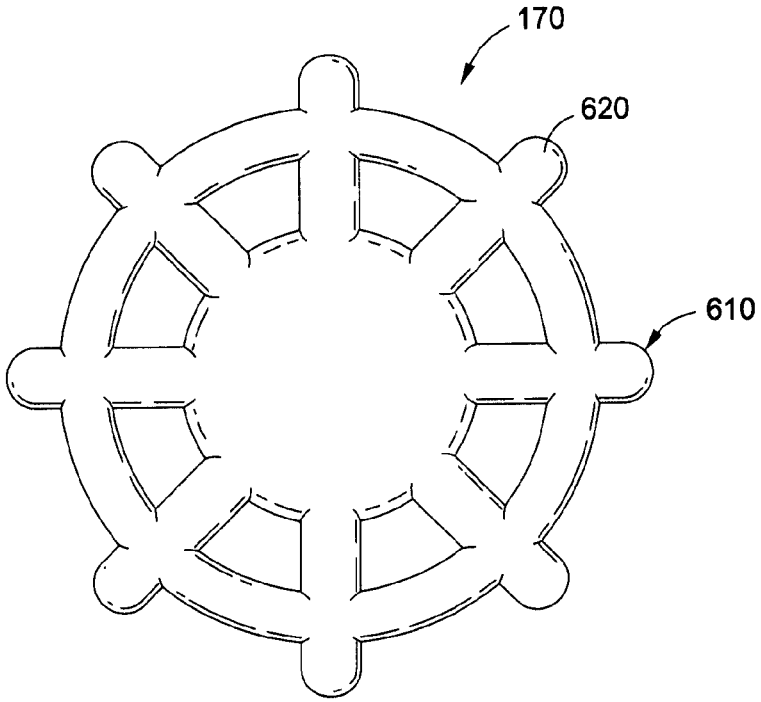
FIG. 6 illustrates a top view showing a cap of a protective cover, in accordance with various aspects of the subject technology.

FIG. 6 illustrates a top view showing the cap 170 of the protective cover 100, in accordance with various aspects of the subject technology. In one aspect, the cap 170 is configured to prevent injury to any individual coming into contact with the end 160 of the reinforcing bar 150. For example, the cap 170 may have rounded edges 610, provide a friendly surface for an individual to brush against 620, and be appropriately sized to prevent injury to the individual by, for example, having a top surface area of about 16 square inches. In some aspects, the cap 170 may have an outer diameter greater than an outer diameter of the collar 110. For example, for a collar 110 with an outer diameter of about 1.8 inches, the cap 170 may have an outer diameter of about 4.4 inches. In another aspect, the collar 110 and the cap 170 are integrally molded. In some aspects, the collar 110 and the cap 170 are integrally molded from a single material, two different materials, or a combination of materials.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A protective cover for covering an end of a reinforcing bar, the protective cover comprising:

a collar made of a first material and having a first end and a second end, the first end adapted to receive the end of the reinforcing bar;

a cap disposed at the second end of the collar, the cap having a surface area of about sixteen square inches;

a seat residing at least within the collar and exposed to direct contact with the end of the reinforcing bar when the reinforcing bar is received in the first end of the collar, the seat comprising a second material different from the first material; and an energy absorption portion residing at least within the collar between the seat and the cap, the seat being less penetrable by the reinforcing bar than is each of the energy absorption portion and the cap.

2. The protective cover of claim 1, wherein the collar comprises a generally cylindrical portion.

3. The protective cover of claim 2, wherein the collar has a generally constant external diameter.

4. The protective cover of claim 1, wherein the first end of the collar comprises a plurality of inwardly extending fins configured to engage an outer surface of the reinforcing bar.

5. The protective cover of claim 4, wherein the fins are configured to accommodate a reinforcing bar of varying diameters.

6. The protective cover of claim 1, wherein the seat is further configured to maintain the protective cover on the end of the reinforcing bar during the impact.

7. The protective cover of claim 6, wherein the seat comprises a generally semi-spherical concave shape.

8. The protective cover of claim 1, wherein the energy absorption portion comprises a split ring positioned between the seat and the cap.

9. The protective cover of claim 1, wherein the energy absorption portion comprises a spring positioned between the seat and the cap.

10. The protective cover of claim 1, wherein the energy absorption portion comprises a high-strength polymer positioned between the seat and the cap.

11. The protective cover of claim 1, wherein the energy absorption portion comprises a crumple zone positioned between the seat and the cap.

12. The protective cover of claim 11, wherein the crumple zone comprises a plurality of openings configured to deflect and deform.

13. The protective cover of claim 1, wherein the energy absorption portion comprises one or more of foam, polymer, rubber, or wood.

14. The protective cover of claim 1, wherein the cap has an outer diameter greater than an outer diameter of the collar.

15. The protective cover of claim 1, wherein the collar and the cap are integrally molded.

16. The protective cover of claim 1, wherein the energy absorption portion comprises a spring positioned between the seat and the cap.

17. A protective cover for covering an end of a reinforcing bar, the protective cover comprising:

a collar made of a first material and having a first end, a second end, and a passage extending into the collar from the first end, the passage configured to receive the end of the reinforcing bar;

a cap disposed at the second end of the collar, the cap having a maximum transverse outer dimension greater than a maximum transverse outer dimension of the collar;

a seat residing at least within the passage and exposed to direct contact with the end of the reinforcing bar when the reinforcing bar is received in the passage, the seat comprising a second material different from the first material; and an energy absorption portion residing at least within the collar between the seat and the cap, the seat being less penetrable by the reinforcing bar than is each of the energy absorption portion and the cap.

18. The protective cover of claim 17, wherein the energy absorption portion comprises a split ring positioned between the seat and the cap.

19. The protective cover of claim 17, wherein the energy absorption portion comprises a high-strength polymer positioned between the seat and the cap.

20. The protective cover of claim 17, wherein the energy absorption portion comprises a crumple zone positioned between the seat and the cap.

21. The protective cover of claim 20, wherein the crumple zone comprises a plurality of openings configured to deflect and deform.

22. The protective cover of claim 17, wherein the energy absorption portion comprises one or more of foam, polymer, rubber, or wood.

23. The protective cover of claim 17, wherein the cap has a surface area of about sixteen square inches.

* * * * *